US007582251B2

(12) United States Patent
Ebner

(10) Patent No.: US 7,582,251 B2
(45) Date of Patent: Sep. 1, 2009

(54) APPARATUS FOR COOLING A STRIP OF SHEET METAL

(75) Inventor: Peter Ebner, Leonding (AT)

(73) Assignee: Ebner Industrieofenbau Gesellschaft m.b.H., Leonding (AT)

( * ) Notice: Subject to any disclaimer, the term of this patent is extended or adjusted under 35 U.S.C. 154(b) by 789 days.

(21) Appl. No.: 11/191,855

(22) Filed: Jul. 28, 2005

(65) Prior Publication Data

US 2006/0027163 A1 Feb. 9, 2006

(30) Foreign Application Priority Data

Aug. 4, 2004 (AT) ..... A 1336/2004

(51) Int. Cl.
*B05C 5/00* (2006.01)

(52) U.S. Cl. ..... 266/113

(58) Field of Classification Search ..... 266/113
See application file for complete search history.

(56) References Cited

U.S. PATENT DOCUMENTS 2,079,494 A * 5/1937 Dantsizen ..... 266/108
3,262,822 A * 7/1966 Griffith ..... 148/688
3,687,145 A * 8/1972 Schrader et al. ..... 266/113
5,640,872 A 6/1997 Plata et al.

FOREIGN PATENT DOCUMENTS

DE 102 07 584 A1 9/2003
EP 0 695 590 A1 7/1995

* cited by examiner

*Primary Examiner*—Scott Kastler
(74) *Attorney, Agent, or Firm*—Collard & Roe, P.C.

(57) ABSTRACT

An apparatus is described for cooling a strip (1) of sheet metal with nozzles (6) for a cooling liquid to be sprayed onto the bottom side of the strip, which nozzles are arranged beneath the strip (1) in transversal rows relative to the feeding direction (3) of the strip. In order to provide advantageous cooling conditions it is proposed that the nozzles (6) configured as fan jet nozzles form a common middle spraying surface (7) for each transversal row and that covers (10) are provided in the spraying region of the nozzles (6) which are laterally adjacent to the strip (1) of sheet metal.

5 Claims, 2 Drawing Sheets

APPARATUS FOR COOLING A STRIP OF SHEET METAL

CROSS REFERENCE TO RELATED APPLICATIONS

Applicant claims priority under 35 U.S.C. §119 Of Austrian Patent Application No. A 1336/2004 filed on Aug. 4, 2004.

FIELD OF THE INVENTION

The invention relates to an apparatus for cooling a strip of sheet metal with nozzles for a cooling liquid to be sprayed onto the bottom side of the strip, which nozzles are arranged beneath the strip in transversal rows relative to the feeding direction of the same.

DESCRIPTION OF THE PRIOR ART

For the purpose of rapidly cooling hot strips of sheet metal it is known (EP 0 695 590 A1) to spray a cooling liquid, especially water, against the bottom and upper side of the strip, which occurs with the help of jet nozzles which are arranged in longitudinal rows distributed over the width of the strip and extending in the feeding direction of the strip and, depending on each longitudinal row, are situated in a common median spraying surface. The fan jets of the nozzles aligned in the feeding direction of the strip are deflected in an alternating manner to both sides with the help of compressed air transversally to the feeding direction of the strip in order to achieve an even cooling of the strip of sheet metal. This is achieved only insufficiently. In order to prevent any dependence of the spraying surface on the pivoting angle of the fan jet nozzles and the uneven accumulation of cooling water on the upper side of the strip it has already been proposed to use full jet nozzles which are arranged in transversal rows beneath the strip relative to the feeding direction of the strip, so that the cooling liquid is only sprayed against the bottom side of the strip of sheet metal. Since in the case of full jet nozzles, which are pressurized with cooling liquid below a preferred, comparatively low pressure of up to 1 bar, the central spraying region shows a high cooling effect, one must expect a shrinkage of the strip of sheet metal starting from these central spray regions, leading to fluctuations in the thickness over the width of the strip, which cannot be prevented even when the full jet nozzles combined in nozzle beams are moved in an oscillating fashion to and fro transversally to the feeding direction of the strip. An additional factor is that in the longitudinal boundary region there is an inevitable different distribution of the sprayed cooling liquid as compared with the region situated in between, so that although it is possible to achieve a more even cooling with this known apparatus, the cooling is still insufficient to meet higher demands placed on a rapid and even cooling of the strip.

SUMMARY OF THE INVENTION

The invention is thus based on the object of providing an apparatus of the kind mentioned above for cooling a strip of sheet metal such that the strip of sheet metal can be cooled evenly over its width despite high cooling rates under avoidance of longitudinal strips caused by differences in thickness.

This object is achieved by the invention that the nozzles configured as fan jet nozzles form a common middle spraying surface for each transversal row and that covers are provided in the spraying region of the nozzles which are laterally adjacent to the strip of sheet metal.

The use of fan jet nozzles whose jets form a common middle spraying surface for each transversal row allows a substantially even distribution of the cooling liquid over the spraying surface, assuming a predetermined alignment of the jet which remains the same during the cooling relative to the bottom side of the strip, because the distribution of liquid which is uneven especially over the longitudinal extension of the spraying region of the individual fan jet nozzles can be offset sufficiently through a respective overlapping of the individual spraying regions. An additional factor is that as a result of the covers which are laterally adjacent to the strip and are in alignment with the bottom side of the strip it is possible to ensure a cooling meeting the conditions in the region between the longitudinal edges, because a wetting of the upper side of the strip in the region of the longitudinal boundary can be avoided which would occur otherwise due to unavoidable turbulent flows, so that the desired even cooling over the width of the strip can be ensured right up to the longitudinal boundary region.

Especially advantageous boundary conditions can be maintained when the covers are in alignment with the bottom side of the strip. The lateral covers in alignment with the bottom side of the strip form a spraying surface extending beyond the width of the strip which enables comparable reflection conditions for the sprayed cooling liquid beyond the edge of the strip.

In order to advantageously utilize the desired effect of lateral covers it is necessary to ensure a low distance between the longitudinal edges of the strip and the laterally adjacent covers. For this purpose, the covers can be displaced transversally to the feeding direction depending on the course of the longitudinal edge of the strip of sheet metal, which can be realized for example in a simple way from a constructional standpoint by scanning the longitudinal edges of the strip and a control device triggered by said scanning for the actuating drives of the covers.

The even sudden use of strip cooling must not be impaired by disturbing influences such as cooling liquid reflected from the housing walls. The same applies to the outlet region of the cooling section. In order to avoid such disturbing influences on the one hand and in order to secure a constructional limitation of the cooling section on the other hand, the spray region of the nozzles in the feeding direction of the strip can be limited by a deflection device for the cooling liquid which is provided beneath the strip of sheet metal. The portion of liquid sprayed by the closest transversal row of nozzles against the deflection device is diverted from the strip before it meets the lower side of the strip, which provides advantageous constructional conditions, especially when the nozzles of the transversal rows at the front and back in the feeding direction of the strip can be set in their inclination about an axis extending in the direction of the transversal row.

BRIEF DESCRIPTION OF THE DRAWINGS

The subject matter of the invention is shown by way of example in the drawings, wherein.

DESCRIPTION OF THE PREFERRED EMBODIMENTS

Figure 1:
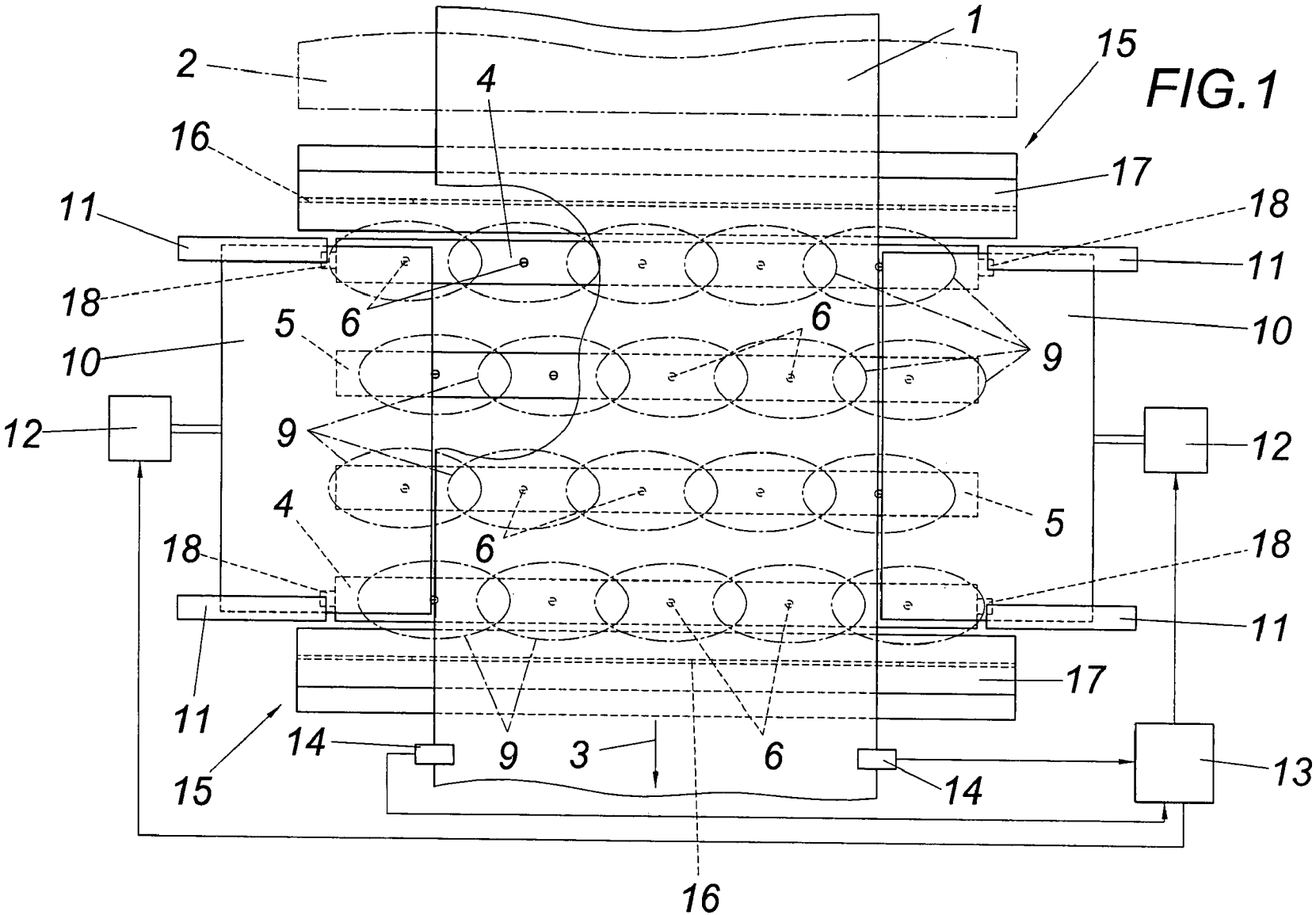
FIG. 1 shows a schematic top view of an apparatus in accordance with the invention for cooling a strip of sheet metal.
Figure 2:
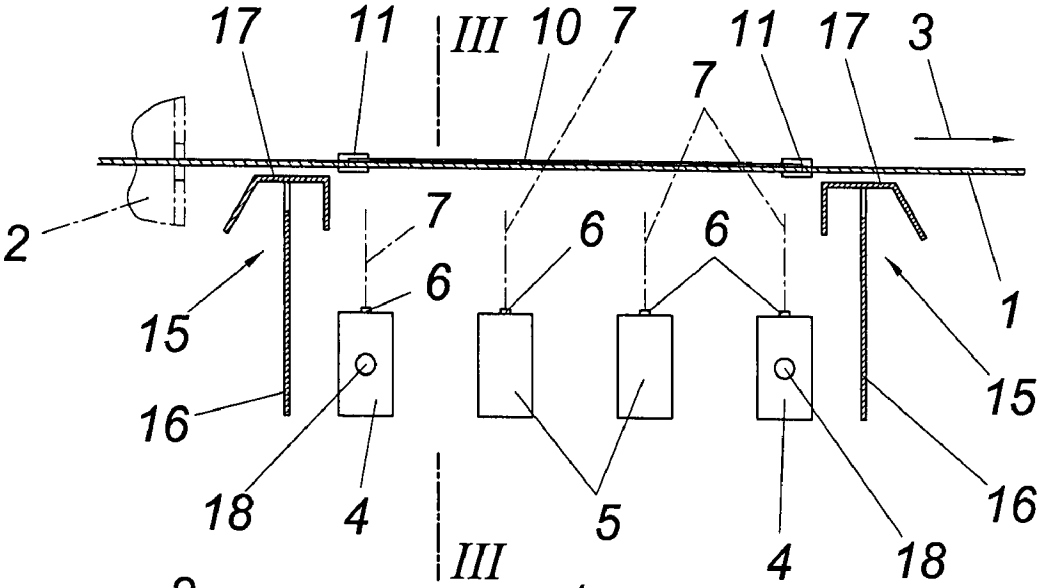
FIG. 2 shows this apparatus in a side view.

The illustrated apparatus for cooling a strip 1 of sheet metal which is conveyed out of a continuous furnace 2 with the help of a supporting air cushion comprises several spray beams 4 and 5 which extend transversally to the feeding direction 3 of the strip 1 of sheet metal and are situated beneath the strip 1 of sheet metal, with the nozzles 6 of the spray beams 4 and 5 configured as fan jet nozzles being arranged in mutually offset transversal rows, as is shown in FIG. 1. Within each transversal row, the nozzles each form a common middle spray surface 7, as is shown in FIG. 2 with the dot-dash line. This means that the spray cones 8 of the fan jet nozzles 6 which overlap one another in the region of the bottom side of the strip and are shown in dot-dash lines in FIG. 3 lead to a spray region 9 on the bottom side of the strip as indicated in FIG. 1 with the dot-dash line, which spray region, in cooperation with the spray regions of the other nozzles of a transversal row, ensures a sufficiently even, strip-like application of the cooling liquid over the width of the strip for the purpose of evenly cooling the strip 1 of sheet metal. Notice must be taken in this connection that the uneven distribution of the cooling liquid of the spray cones in the direction of the nozzle beams 4, 5 can be offset substantially by the overlapping of the spray regions 9.

Figure 3:
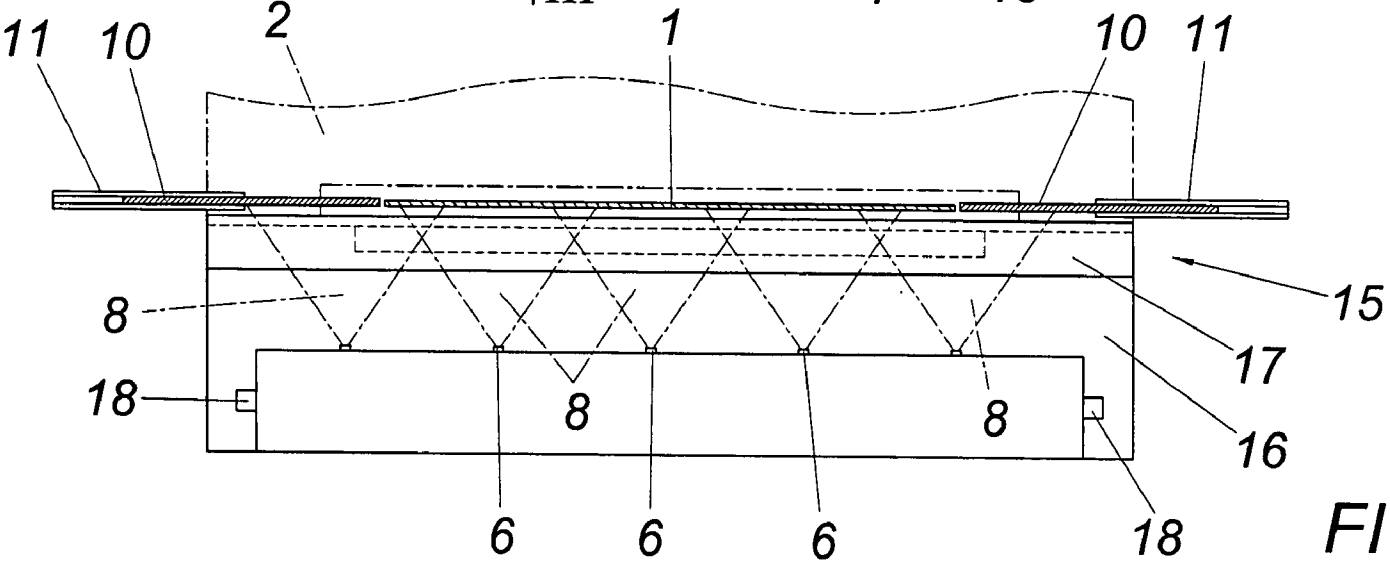
FIG. 3 shows a sectional view along line III-III of FIG. 2.

As is shown especially in FIGS. 1 and 3, lateral covers 10 are adjacent to the longitudinal edges of the strip 1 of sheet metal on both sides of the strip 1 along the cooling section determined by the nozzle beams 4 and 5. These covers 10 are in alignment with the bottom side of the strip, which is thus enlarged by the covers 10 with respect to the spraying surface. This means that otherwise unavoidable disturbing influences on the spraying of the cooling liquid in the longitudinal boundary region can be avoided. The lateral covers 10 not only ensure even reflection conditions for the sprayed cooling liquid which continue beyond the edge of the strip, but also prevent cooling liquid from reaching the upper side of the strip of sheet metal in the longitudinal boundary region. By preventing the disturbing influences caused by the edges, advantageous cooling of the strip of sheet metal is ensured in cooperation with the aligned spray cones 8 of the fan jet nozzles 6, which despite the high cooling rate does not lead to any uneven deformations of the strip.

In order to keep the distance between the longitudinal edges of the strip 1 and the lateral covers 10 sufficiently small, the covers 10 are held in a displaceable manner in guides 11 extending transversally to the feeding direction 3 and are connected with actuating drives 12, which are controlled according to FIG. 1 via a control device 13 depending on the course of the longitudinal edge of the strip 1. For this purpose, the course of the longitudinal edge of the strip 1 is scanned via sensors 14 whose output signals are sent to the control device 13.

To ensure that cooling conditions can be observed which are substantially relieved from any disturbing influences in the front and rear end regions of the cooling section defined by the nozzle beams 4, 5, this cooling section is delimited by deflection devices 15 for the cooling liquid which are provided beneath the strip 1 of sheet metal. These deflection devices 15 each consist of a boundary wall 16 with a deflection profile 17 overlapping the same at a distance, as is shown especially in FIG. 2. These deflection devices 15 enable defining the spray region of the nozzle beams 4 at the edge in a constructional manner, because the portion of the cooling liquid sprayed against the deflection device 17 is carried off from the spray region, so that disturbing influences are prevented which are caused by reflections of the cooling liquid on walls of the cooling apparatus provided in this region. In connection with a pivoting bearing of the nozzle beams 4, the cooling conditions at the beginning and end of the cooling section can be set according to the respective conditions. The pivoting capability of the nozzle beams 4 at the boundary side is indicated in the drawing by swivel pins 18.

It is understood that an additional influence can be taken on the cooling effect by a change of the distance of the nozzle beams 4 and 5 from the bottom side of the strip and by a change of the pressurization of the cooling liquid. An advantageous pressurization for the cooling liquid is a pressure of between 1 bar and 3.5 bar.

The invention claimed is:

1. An apparatus for cooling a strip of sheet metal with nozzles for a cooling liquid to be sprayed onto the bottom side of the strip, which nozzles are arranged beneath the strip in transversal rows relative to the feeding direction of the strip, wherein the nozzles (6) configured as fan jet nozzles form a common middle spraying surface (7) for each transversal row and wherein covers (10) are provided in the spraying region of the nozzles (6) and are laterally adjacent to the strip (1) of sheet metal.

2. An apparatus according to claim 1, wherein the covers (10) are in alignment with the bottom side of the strip.

3. An apparatus according to claim 1, wherein the covers (10) can be displaced transversally to the feeding direction (3) depending on the course of the longitudinal edge of the strip (1) of sheet metal.

4. An apparatus according to claim 1, wherein the spray region (9) of the nozzles (6) in the feeding direction (3) of the strip is limited by a deflection device (15) for the cooling liquid which is provided beneath the strip (1) of sheet metal.

5. An apparatus according to claim 1, wherein the nozzles (6) of the transversal rows which are at the front and back in the feeding direction (3) of the strip can be set in their inclination about an axis (18) extending in the direction of the transversal row.

* * * * *

UNITED STATES PATENT AND TRADEMARK OFFICE

CERTIFICATE OF CORRECTION

PATENT NO. : 7,582,251 B2
APPLICATION NO. : 11/191855
DATED : September 1, 2009
INVENTOR(S) : Peter Ebner It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1068 days.

Signed and Sealed this

Fourteenth Day of September, 2010

David J. Kappos

David J. Kappos
*Director of the United States Patent and Trademark Office*